United States Patent [19]

Houle et al.

[11] 4,365,367

[45] Dec. 28, 1982

[54] BATHING UNITS WITH DOOR CONTROLLER

[75] Inventors: Raymond T. Houle, Traverse City; Michael A. Redwine, Acme; Fredrick A. Kilbourn, Suttons Bay, all of Mich.; Stewart D. Reed, El Toro, Calif.; Arthur A. Sills; John H. Kraft, both of Traverse City, Mich.

[73] Assignee: Silchor, Traverse City, Mich.

[21] Appl. No.: 187,338

[22] Filed: Sep. 15, 1980

[51] Int. Cl.[3] ..... A47K 3/02

[52] U.S. Cl. ..... 4/555; 4/538; 4/557

[58] Field of Search ..... 4/555, 556, 538, 557

[56] References Cited

U.S. PATENT DOCUMENTS

| | | | |
|---|---|---|---|
| D. 143,204 | 12/1945 | Fleischhauer . | |
| D. 257,058 | 11/1980 | Laver | D23/55 |
| 2,081,728 | 5/1937 | Bassett . | |
| 2,569,825 | 10/1951 | Otis . | |
| 2,570,053 | 10/1951 | Fowler et al. . | |
| 2,576,623 | 11/1951 | McLaughlin . | |
| 2,587,335 | 2/1952 | Landergott | 4/180 |
| 2,804,629 | 9/1957 | Ring | 4/173 |
| 2,936,463 | 5/1960 | Tracy | 4/149 |
| 2,977,604 | 4/1961 | Miller . | |
| 3,066,316 | 12/1962 | Russell . | |
| 3,113,323 | 12/1963 | Beardsley . | |
| 3,270,353 | 9/1966 | Berthelsen et al. | 5/81 |
| 3,366,978 | 2/1968 | Jones . | |
| 3,371,354 | 3/1968 | Hayslett . | |
| 3,371,357 | 3/1968 | Berthelsen et al. | 5/83 |
| 3,380,078 | 4/1968 | Hanson | 4/555 |
| 3,416,166 | 12/1968 | Hanson | 4/555 |
| 3,423,769 | 1/1969 | Cowley | 4/173 |
| 3,467,969 | 9/1969 | Szekely . | |
| 3,496,579 | 2/1970 | Petersen . | |
| 3,562,821 | 2/1971 | Queen . | |
| 3,604,018 | 9/1971 | Moran | 4/173 |
| 3,662,409 | 5/1972 | Johansson . | |
| 3,663,971 | 5/1972 | Bonhote . | |
| 3,703,733 | 11/1972 | McLoughlin . | |
| 3,719,960 | 3/1973 | Russell . | |
| 3,736,924 | 6/1973 | Jacuzzi et al. . | |
| 3,815,163 | 6/1974 | Sullivan | 4/185 L |
| 3,827,086 | 8/1974 | Seymour et al. | 4/175 |
| 3,827,087 | 8/1974 | Cuthbertson . | |
| 3,863,275 | 2/1975 | Brendgord et al. | 4/556 |
| 3,879,770 | 4/1975 | Grant | 4/185 L |
| 3,900,906 | 8/1975 | Berthelsen | 5/62 |
| 3,924,278 | 12/1975 | Ekman . | |
| 4,067,071 | 1/1978 | Altman et al. | 4/145 |
| 4,080,710 | 3/1978 | Hess | 29/416 |
| 4,099,272 | 7/1978 | Sowder | 4/555 |
| 4,118,810 | 10/1978 | Brickhouse et al. | 4/556 |
| 4,160,292 | 7/1979 | Kuether et al. . | |

FOREIGN PATENT DOCUMENTS

| | | | |
|---|---|---|---|
| 1213358 | 11/1970 | United Kingdom | 4/555 |
| 1226206 | 3/1971 | United Kingdom | 4/555 |
| 1554165 | 10/1979 | United Kingdom | 4/555 |

*Primary Examiner*—Henry K. Artis

*Attorney, Agent, or Firm*—Price, Heneveld, Huizenga and Cooper

[57] ABSTRACT

A bathing apparatus for invalids and the like, comprises a bathtub having a lateral opening in one side thereof for invalid ingress and egress, a door selectively closing the bathtub opening, and a seal positioned between the door and the bathtub. The door is slidably mounted in a pair of tracks disposed on opposite sides of the door for vertically translating the door between open and closed positions. A counterbalance for the door comprises a pair of spools mounted on opposite ends of a spring loaded axle, and a pair of flexible lines having one pair of ends wrapped around the spools, and the opposite ends attached to the door, whereby downward translation of the door tenses the spring and counterbalances the weight of the door. A lock for the door comprises a foot operated lever arrangement, which engages both sides of the door and positively pulls the same downwardly against the seal into the closed position.

22 Claims, 9 Drawing Figures

BATHING UNITS WITH DOOR CONTROLLER

CROSS-REFERENCE TO RELATED APPLICATIONS

The present application is related to our copending U.S. patent application Ser. No. 187,522, filed Sept. 15, 1980 entitled APPARATUS AND METHOD FOR BATHING INVALIDS, which is hereby incorporated by reference.

BACKGROUND OF THE INVENTION

The present invention relates to an apparatus for bathing invalids, and in particular to a controller for bathing units with an overhead door.

Our above-referenced patent application discloses a bathtub having a lateral opening in one side thereof to permit invalid ingress and egress, and an overhead door assembly for selectively closing the opening. The door includes a sealing edge, having a generally wedge-shaped, upwardly opening contour, which mates with a lip defining the lateral opening. The door is slidably mounted on a pair of tracks disposed on opposite sides of the door, whereby the door is vertically translated into a closed position, and rotated as it is raised into a substantially horizontal, overhead storage position. A compression seal is attached to the door sealing edge, and is compressed against the lip to form a watertight seal therebetween which is sufficiently leakproof to maintain a head of water in the bathtub for immersal bathing of an invalid.

The door must be securely locked in the closed position with the seal firmly and evenly compressed to maintain a watertight seal, particularly when the tub is completely filled during immersal bathing. Further, the door must translate freely between the closed and open positions, and is preferably counterbalanced for safety purposes, as well as ease of operation.

SUMMARY OF THE INVENTION

One aspect of the present invention is to provide a counterbalance mechanism for bathing units with an overhead door which assists the operator in lifting the door, and retains the door stationary in any selected position. The counterbalanced mechanism is preferably concealed in the base of the bathing unit, and is attached to the door by guided cables which are positioned in tracks between which the door slides.

Another aspect of the present invention is to provide a lock for the door which positively pulls the door into the closed, sealed position, and securely retains the same therein. The lock is preferably foot operated for ease of use, and simultaneously latches both sides of the door in place.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
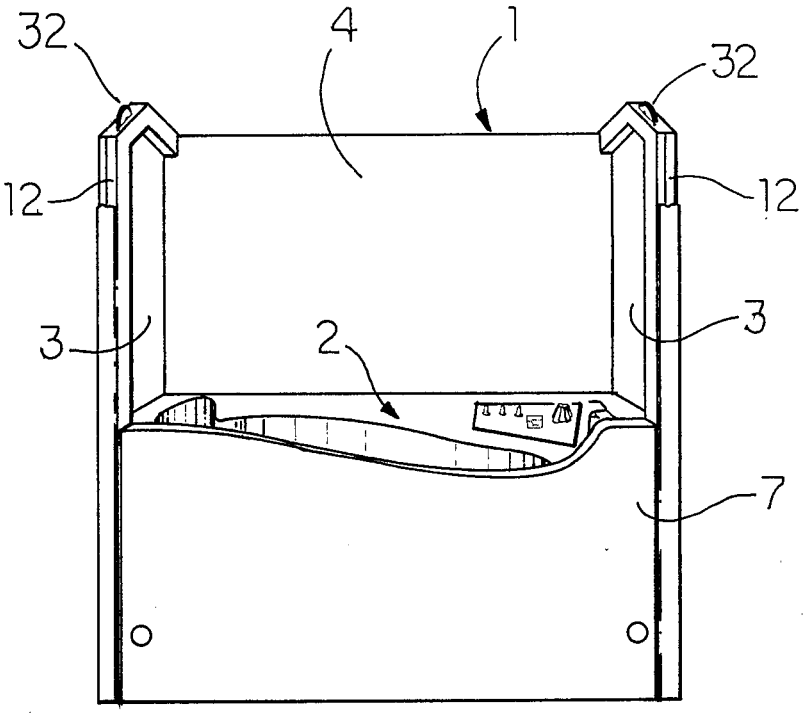
FIGS. 1–6 are illustrations of a bathing unit embodying the invention, particularly showing a counterbalance mechanism for the overhead door.
Figure 2:
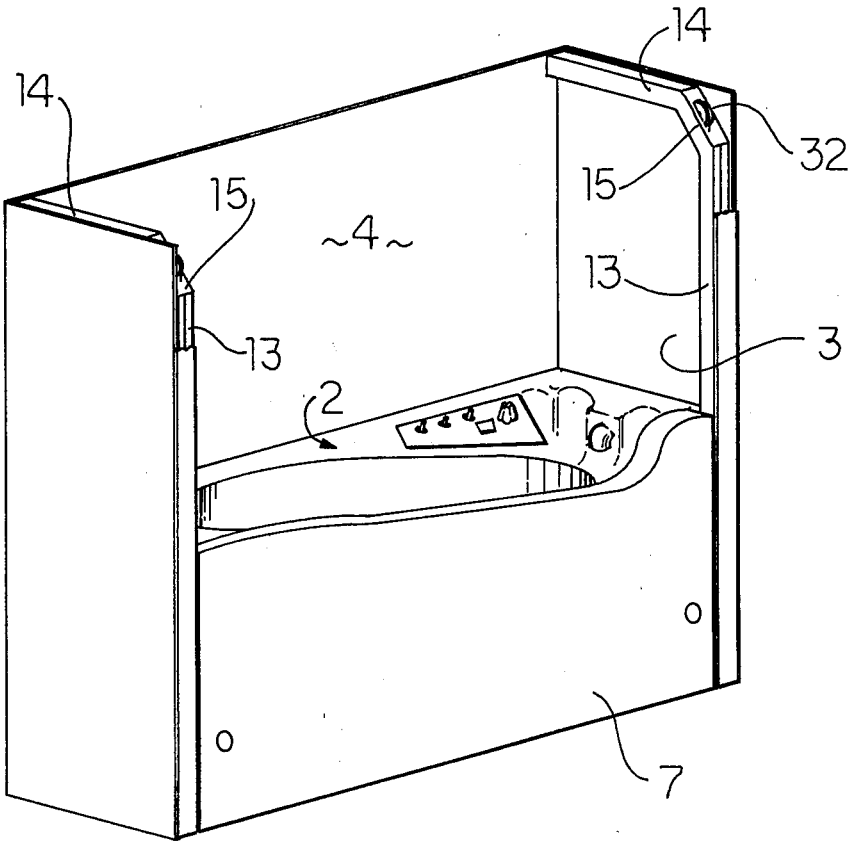

For purposes of description herein, the terms "vertical," "horizontal," "left," "right," and derivitives thereof shall relate to the invention as oriented in FIG. 1. However, it is to be understood that the invention may assume various alternative orientations, except where expressly specified to the contrary.

Figure 3:
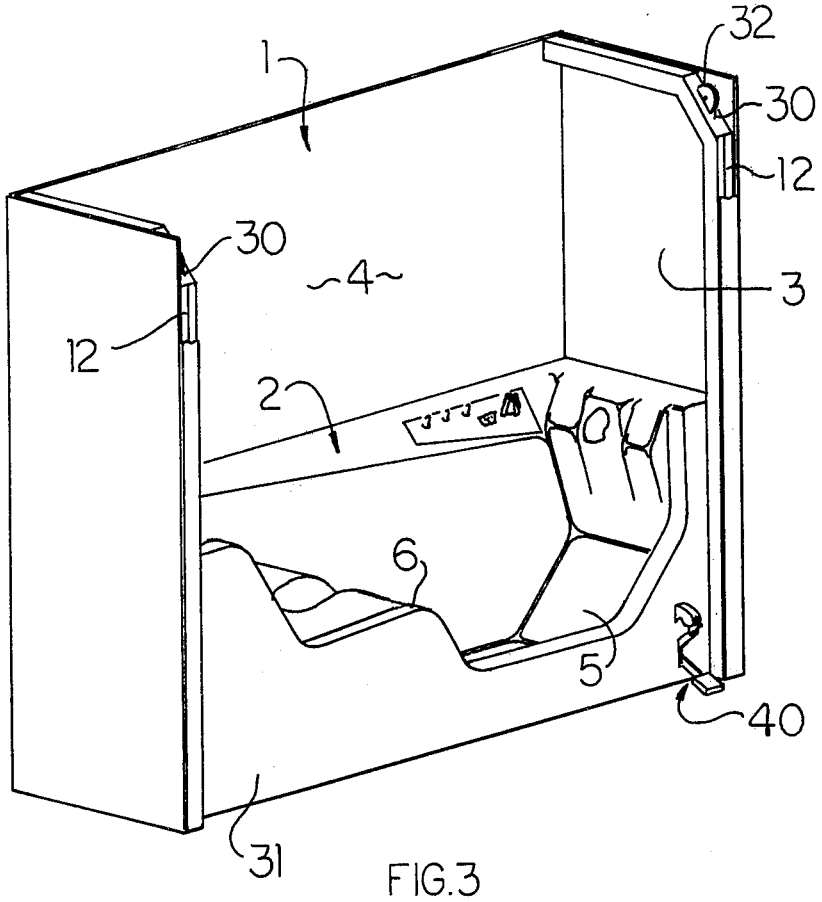

The reference numeral 1 (FIG. 1) generally designates a bathing unit comprising a bathtub 2 with opposing end walls 3 and a back wall 4 upstanding from the rim of the bathtub to form a stall. Bathtub 2 includes a lateral opening 5 (FIG. 3) defined by a lip 6, and is substantially identical with our aforementioned invention as disclosed in the copending patent application incorporated by reference herein. A door 7 selectively closes opening 5, and includes a sealing edge 8 (FIG. 5) having a generally wedge-shaped, upwardly opening contour which mates with the shape of bathtub lip 6. A compression seal (not shown) is positioned between the lip 6 and sealing edge 8, and forms a leakproof seal when the door is closed.

Door 7 is slidably mounted on a pair of rails or tracks 12 supported on opposite sides of the unit. Each track 12 includes a vertical section 13, extending along the front sides of the unit, a horizontal segment 14 extending along the upper edges of the end walls 3, and an inclined segment 15 interconnecting segments 13 and 14. Door 7 is mounted on tracks 12 by roller brackets 16, having wheels 17 positioned within the interior ot the track. The door translates vertically downwardly into the closed position, wherein the seal is compressed between edge 8 and lip 6, and is rotated as it is raised, into a substantially horizontal, overhead storage position.

Figure 4:
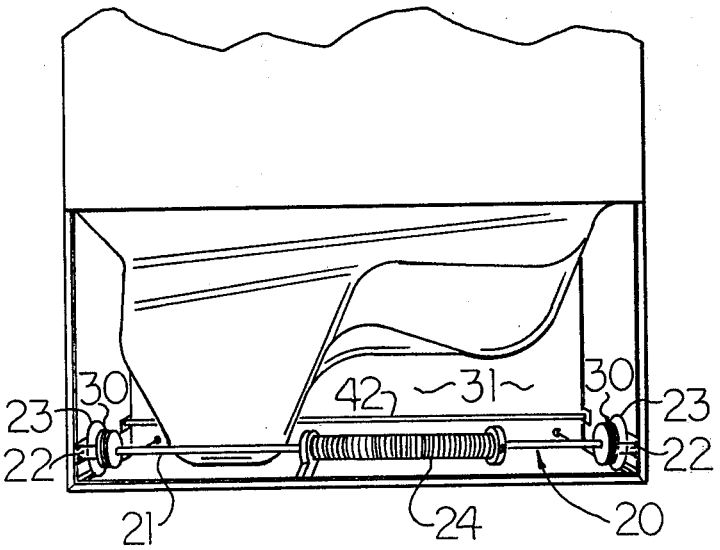

A counterbalanced mechanism 20 (FIG. 4) is attached to door 7, and comprises an axle 21 mounted along the back of the unit in a concealed area at the interior side of the tub. Axle 21 is oriented parallel with the closed door, and rotatably mounted in bearings 22. A spool or drum 23 is mounted on each end of axle 21 for rotation therewith. A torsion spring 24 has one end fixed on center bearing 22, and the other end connected with axle 21 at sleeve 25, whereby rotation of axle 21 tenses spring 24. Drums 23 are rotatably adjustable on axle 21 to adjust cable tension, as described below.

Figure 5:
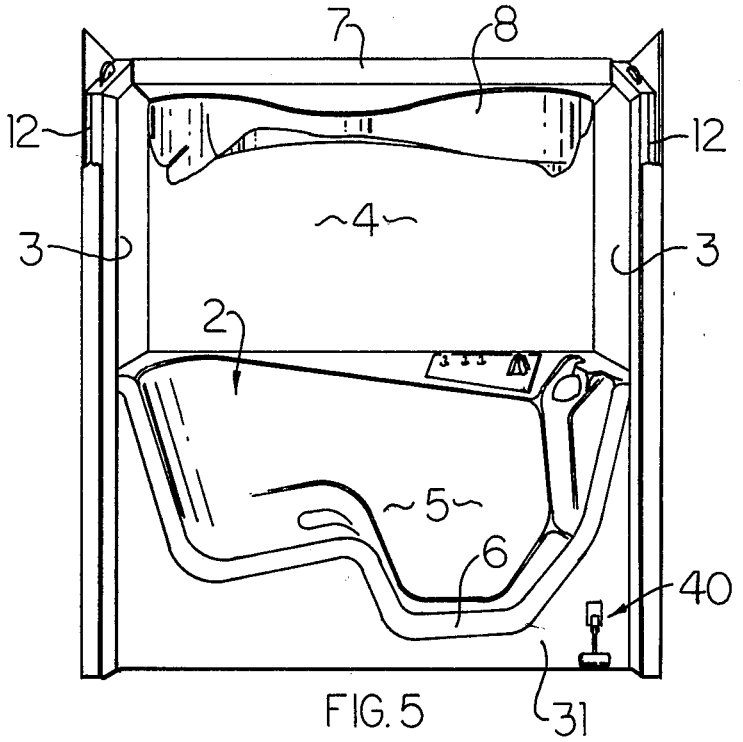
Figure 6:
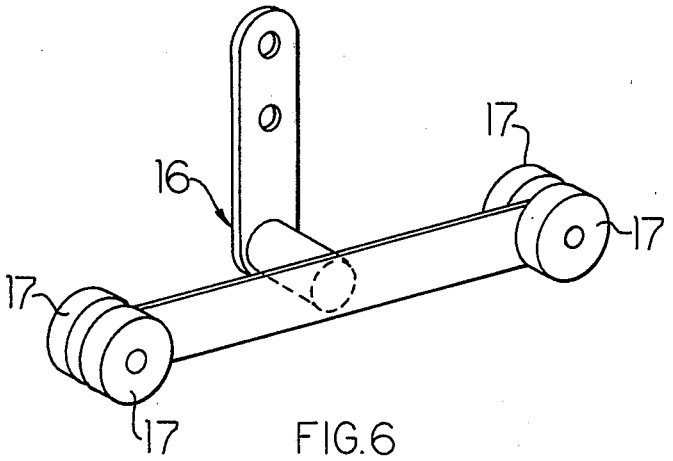

Two lines or cables 30 (FIG. 4) are attached to drums 23 and are wrapped thereabout. The cables 30 extend from drums 23, through the front wall 31 of the unit at aligned apertures, through an aperture in the base of tracks 12, around a roller bearing mounted therein, up through the tracks to pulleys 32. Cables 30 extend over pulleys 32, back down through tracks 12, with the terminal ends attached to roller brackets 16. Spring 23 is pretensed so that the door 7 will remain stationary when placed in virtually any selected position. The terminal end of cables 30 are attached to the lower set of roller brackets 16, so that when door 7 is raised, it will rotate into a substantially horizontal orientation in the overhead storage position, as shown in FIG. 5.

Figure 7:
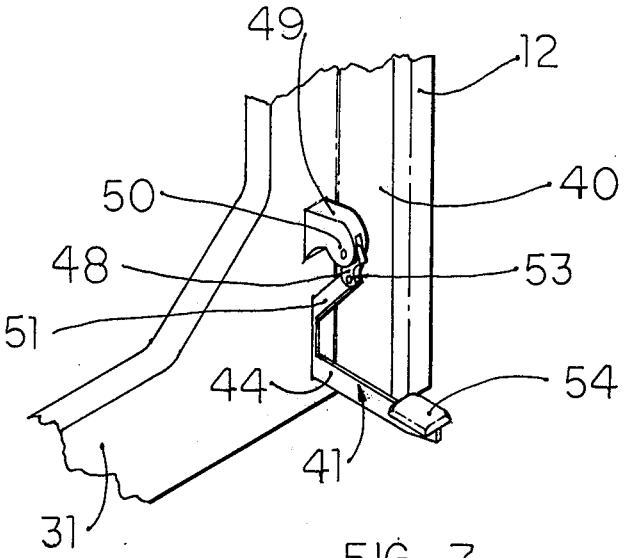
FIGS. 7–9 are illustrations of the bathing unit, particularly showing a lock mechanism for the door.
Figure 8:
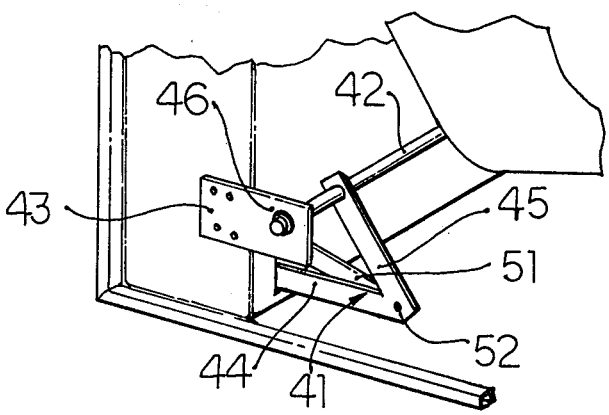
Figure 9:
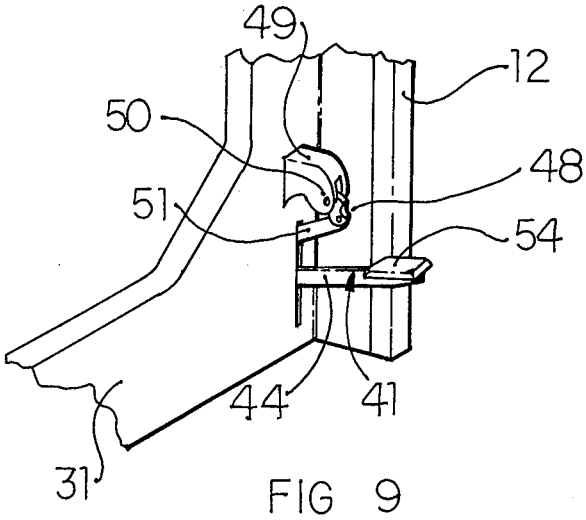

A lock mechanism 40 is illustrated in FIGS. 7–9, and includes a foot lever 41 pivotally mounted in the tub on an axle 42. Axle 42 is rotatably mounted in bearings 43, and extends along the front wall 31 of the tub on the interior side thereof. Foot lever 41 is generally L-shaped with horizontal leg 44, and upstanding leg 45. The free end of leg 45 is welded to axle 42, such that lever 41 rotates in a generally vertical plane. The forward end of foot lever 41 is adapted for engagement with the foot of the operator, and is preferably provided with a pedal (not shown). Foot lever pivots about point 46 in bearings 43.

A latch arm 48 is pivotally mounted on the front of wall 31 by a bracket 49. The upper end of latch arm 48 is hook-shaped, and the lower end contains apertures for purposes to be described below. Latch arm 48 pivots about point 50 to pivot the hook-shaped end disposed near the door 7 when it is closed. A link 51 has one pivotally attached to lever arm 54 at point 52, and the other end pivotally attached to the lower end of latch arm 48 at point 53, such that rotation of foot lever 41 pivots latch arm 48 between an open position (FIG. 9) and a closed position (FIG. 7). The distance between pivot points 46 and 52 is substantially greater than the distance between pivot points 50 and 53 such that the latch arm 48 locks with a mechanical advantage. Preferably, lever arm 54 is also apertured along its length, so that the position of link 51 can be varied to adjust the position and mechanical advantage of the linkage system.

A second latch is attached to the other side of door 7, without lever arm 44, and is welded to axle 42 so that both arms 45 rotate together and simultaneously latch both sides of the door.

The hook end of latch arm 48 extends between the side of the rail and the side of the door 7, and abuttingly engages the top of an exposed portion of the lower roller bracket 16. As the door 7 is closed, the exposed bracket portion forms a catch, and engages the open hook end of latch arm 48 in the position shown in FIG. 9. The door 7 is then pushed downwardly by the attendant as far as possible. The attendant then steps on the pedal of the outer end of foot lever 41, thereby rotating axle 42 and latch arm 48. The downward rotation of latch arm 48 positively engages the catches on door 7 and pulls the door down with mechanical advantage to securely and evenly compress the seal. Lever arm 41 is slightly flexible in the lateral direction, like a leaf spring, and is translated around a fixed stop 54 which holds lever 41 in the closed door position. Preferably a spring (not shown) is attached to one of the linkage members to return the mechanism to the release position, wherein the pedal is fully up.

The embodiments of the invention in which an exclusive property or privilege is claimed are defined as follows:

1. In combination, a bathing apparatus for invalids and the like, comprising a bathtub having a lateral opening in one side thereof for invalid ingress and egress, a door selectively closing said bathtub opening, means for forming a seal between said door and said bathtub when said door is in a closed position, a pair of tracks supported on opposite sides of said door and extending vertically upwardly, and means for slidably mounting said door on said tracks for vertical translation, a counterbalance for said door, comprising:

first and second flexible lines having first ends thereof attached to opposite sides of said door;

an axle rotatably mounted adjacent said bathing apparatus;

first and second spools attached to said axle for rotation therewith, and having second ends of said lines connected with a different one of said spools and wrapped thereabout, whereby axle rotation translates said lines;

a spring having one end fixed and the other end connected with said axle whereby downward translation of said door tenses said spring and counterbalances the weight of said door.

2. A bathing apparatus as set forth in claim 1, including:

means for pretensing said spring, whereby said door will remain stationary in substantially any position in which it is placed.

3. A bathing apparatus as set forth in claim 1, wherein:

said bathtub includes a concealed interior; and said axle, said spools, and said spring are disposed in said concealed bathtub interior, and are not visible from the front of said bathing apparatus.

4. A bathing apparatus as set forth in claim 1, including:

means for slidably guiding said lines between said spools and upper ends of said tracks.

5. A bathing apparatus as set forth in claim 4, wherein:

said guiding means includes a first pair of bearings mounted directly above the upper ends of said tracks, and a second pair of bearings mounted in lower ends of said tracks; and said lines extend from said spools, over said second bearings, up said tracks, over said first bearings, and back down said tracks; with the first ends of said lines connected with said door slide mounting means.

6. A bathing apparatus as set forth in claim 5, wherein:

said first and second pairs of bearings comprise rollers.

7. A bathing apparatus as set forth in claim 1, wherein:

said tracks have a generally inverted L-shape, are supported on the opposite sides of said door, and are oriented to translate said door vertically into the closed position, and rotate said door as it is raised from the closed position into a substantially horizontal, overhead storage position directly over said bathtub.

8. A bathing apparatus as set forth in claim 7, wherein:

said door slide mounting means comprises upper and lower slides connected with and projecting from each side of said door, and slidingly received in said tracks.

9. A bathing apparatus as set forth in claim 8, wherein:

said first ends of said lines being connected with said lower door slides to retain said door in the overhead position.

10. A bathing apparatus as set forth in claim 9, wherein:

said slides comprise rollers.

11. A bathing apparatus as set forth in claim 1, including:

means for adjusting the angular position of at least one of said spools on said axle to adjust the tension in said lines.

12. A bathing apparatus as set forth in claim 11, including:

means for pretensing said spring, whereby said door will remain stationary in substantially any position in which it is placed.

13. A bathing apparatus as set forth in claim 12, wherein:

said bathtub includes a concealed interior; and said axle, said spools, and said spring are disposed in said concealed bathtub interior, and are not visible from the front of said bathing apparatus.

14. A bathing apparatus as set forth in claim 13, including:

means for slidably guiding said lines between said spools and upper ends of said tracks.

15. A bathing apparatus as set forth in claim 14, wherein:

said guiding means includes a first pair of bearings mounted directly above the upper ends of said tracks, and a second pair of bearings mounted in lower ends of said tracks; and said lines extend from said spools, over said second bearings, up said tracks, over said first bearings, and back down said tracks, with the first ends of said lines connected with said door slide mounting means.

16. A bathing apparatus as set forth in claim 15, wherein:

said tracks have a generally inverted L-shape, are supported on the opposite sides of said door, and are oriented to translate said door vertically into the closed position, and rotate said door as it is raised from the closed position into a substantially horizontal, overhead storage position directly over said bathtub.

17. In combination, a bathing apparatus for invalids and the like, comprising a bathtub having a lateral opening in one side for invalid ingress and egress, wherein said opening is defined by a lip having a generally wedge-shaped contour which opens upwardly; a door selectively closing said opening, including a sealing edge with a generally wedge shape which conforms to the contour of said lip; a compression seal connected with one of said lip and said sealing edge; and means for vertically translating said door into a closed position wherein said door and said bathtub are converged to compress said seal between said lip and said sealing edge and form a seal therebetween which is leakproof when said bathtub is filled with water to a level substantially above a base portion of said lip for immersal bathing of an invalid, a door lock, comprising:

a lever pivotally mounted in a forward portion of one of said bathtub and said door at a first pivot point, and having an exposed end for manipulating said lever;

a latch arm pivotally mounted in said one of said bathtub and said door at a second pivot point, and including a first, outer end;

a catch connected with the other of said bathtub and said door, and being positioned adjacent to the lock engaging end of said latch arm for selective abutment therewith;

a link having one end pivotally connected with said lever at a third pivot point which is spaced apart from said first pivot point, and the other end of said link being pivotally connected with said latch arm at a fourth pivot point which is spaced apart from said third pivot point, whereby rotation of said lever pivots said latch arm outer end into engagement with said catch, and positively pulls said door downwardly into the closed position; and means for retaining said lever in the closed door position.

18. A bathing apparatus as set forth in claim 17, wherein:

said lever is mounted in a base portion of said bathing apparatus for foot manipulation along a generally vertical plane.

19. A bathing apparatus as set forth in claim 18, wherein:

said lever is generally L-shaped, with a substantially horizontal first leg, and a second leg upstanding therefrom; said lever first leg having a pedal at an outer end thereof for foot manipulation, and said lever being attached to said bathing apparatus at a free end of said second leg; said link one end being connected with said lever at said second leg, a spaced apart distance from said first pivot point, and the distance between said first and third pivot points being substantially greater than the distance between said second and fourth pivot points, thereby providing a mechanical advantage in the locking action of said latch arm.

20. A bathing apparatus as set forth in claim 19, wherein:

said lever second leg and the second end of said latch arm each include a plurality of apertures along their length for adjusting the position of said pivot points to vary the mechanical advantage on said latch arm.

21. A bathing apparatus as set forth in claim 17, wherein:

said door translating means comprises a pair of tracks supported on opposite sides of said door, and extending vertically upwardly, and rollers mounted in said tracks and attached to opposite sides of said door by brackets; and said catch comprises an exposed portion of one of said brackets disposed between the side of the door and the side of an associated one of said tracks.

22. A bathing apparatus as set forth in claim 17, wherein:

said lock includes a latch assembly disposed at both sides of said door, and includes means for interconnecting said latch assemblies for simultaneously locking both sides of the door in the locked position at the same time.

* * * * *

UNITED STATES PATENT AND TRADEMARK OFFICE

CERTIFICATE OF CORRECTION

PATENT NO. : 4,365,367

DATED : December 28, 1982

INVENTOR(S) : Raymond T. Houle et al

It is certified that error appears in the above-identified patent and that said Letters Patent is hereby corrected as shown below:

Column 2, line 31:

"ot" should be --of--;

Column 3, line 11:

"54" should be --45--; and

Column 3, line 19:

"54" should be --45--.

Signed and Sealed this

Second Day of August 1983

[SEAL]

*Attest:*

GERALD J. MOSSINGHOFF

*Attesting Officer*

*Commissioner of Patents and Trademarks*